United States Patent [19]

Welsh

[11] Patent Number: 4,903,786

[45] **Date of Patent: * Feb. 27, 1990**

[54] EARTH BORING BIT WITH IMPROVED TWO PIECE BEARING AND SEAL ASSEMBLY

[75] Inventor: Michael F. Welsh, Houston, Tex.

[73] Assignee: Hughes Tool Company, Houston, Tex.

[ * ] Notice: The portion of the term of this patent subsequent to Jun. 28, 2005 has been disclaimed.

[21] Appl. No.: 210,682

[22] Filed: Jun. 23, 1988

[51] Int. Cl.[4] ..... E21B 10/20; E21B 10/22

[52] U.S. Cl. ..... 175/367; 175/371; 277/92; 384/94; 384/95

[58] Field of Search ..... 175/367–372; 384/92–96; 277/92

[56] References Cited

U.S. PATENT DOCUMENTS

| | | | |
|---|---|---|---|
| 1,634,318 | 7/1927 | Bull | 175/369 |
| 1,884,965 | 10/1932 | Bagget . | |
| 4,176,848 | 12/1979 | Lafuze | 384/94 X |
| 4,478,299 | 10/1984 | Dorosz | 175/369 |
| 4,516,641 | 5/1985 | Burr | 175/228 |
| 4,572,306 | 2/1986 | Dorosz | 175/371 |
| 4,600,064 | 7/1986 | Scales et al. | 175/368 |
| 4,666,001 | 5/1987 | Burr | 175/371 |
| 4,671,368 | 6/1987 | Burr | 175/371 |
| 4,753,303 | 6/1988 | Burr | 175/367 |

*Primary Examiner*—Hoang C. Dang

*Attorney, Agent, or Firm*—Robert A. Felsman

[57] ABSTRACT

An earth boring bit having an improved two piece bearing and seal assembly containing a cantilevered bearing lug that is threaded to receive a mating bearing sleeve, the lug having a transverse shoulder intersected by a mouth on the sleeve to define a bearing shaft upon which is supported a rotatable cutter. A lubrication system includes a hydrostatic pressure compensator and seal means, the transverse shoulder being positioned inwardly of the seal means toward an inner end region of the lug to avoid exposure of the transverse shoulder of the lug and the mouth of the bearing sleeve to ambient drilling fluid. The seal means is a rigid face seal assembly which includes a rigid, sealing ring and a resilient energizer ring.

3 Claims, 2 Drawing Sheets

EARTH BORING BIT WITH IMPROVED TWO PIECE BEARING AND SEAL ASSEMBLY

CROSS REFERENCE TO RELATED APPLICATIONS

This application has disclosure in common with an application of Joseph L. Kelly, Jr., entitled "VOLUME AND PRESSURE BALANCED RIGID FACE SEAL FOR ROCK BITS", Ser. No. 023,178, Filed Mar. 9, 1987 now U.S. Pat. No. 4,753,304, and also with "EARTH BORING BIT WITH TWO PIECE BEARING AND RIGID FACE SEAL ASSEMBLY", Ser. No. 023,170, Filed Mar. 9, 1987, now U.S. Pat. No. 4,753,303, both belonging to a common assignee.

BACKGROUND OF THE INVENTION

1. Field of the Invention

This invention relates to earth boring bits, lubricated with a system which includes a hydrostatic pressure compensator to balance the internal pressure of the lubricant inside the bit with the hydrostatic pressure of a liquid drilling fluid that surrounds the bit during drilling. In this combination, the specific improvement relates to the seal and bearing assembly between each cutter and bearing shaft.

2. Background Information

A two piece bearing construction is disclosed in U.S. Pat. No. 4,600,064, "EARTH BORING BIT WITH BEARING SLEEVE", July 15, 1986. An internally tapered and threaded bearing sleeve is made up on a mating, externally threaded bearing lug. The mouth of the sleeve engages a shoulder on the base region of the bearing lug and has a selected radial thickness such that the sleeve may be made up to a selected torque. Also, the bearing sleeve has a length greater than that of the threaded portion to define a thick walled inner end region to receive a resilient retainer ring in a groove that provides a selected section over the threads on the interior of the sleeve.

A successful earth boring bit having an improved rigid face seal assembly is disclosed in U.S. Pat. No. 4,516,641, "EARTH BORING BIT WITH PRESSURE COMPENSATING RIGID FACE SEAL", May 14, 1985. Further improvements are disclosed in U.S. Pat. No. 4,666,001, "EARTH BORING BIT WITH IMPROVED RIGID FACE SEAL ASSEMBLY", May 19, 1987.

An improvement that utilizes a rigid face seal assembly with a two piece bearing in a rock bit is disclosed in an application entitled "EARTH BORING BIT WITH TWO PIECE BEARING AND RIGID FACE SEAL ASSEMBLY", Ser. No. 023,170 filed Mar. 9, 1987, now U.S. Pat. No. 4,753,303.

SUMMARY OF THE INVENTION

It is the general object of the invention to provide in an earth boring bit an improved two piece bearing sleeve and seal assembly. The bit body includes a cantilevered bearing lug that is threaded to receive a mating bearing sleeve. A base region of the lug has a transverse shoulder which is engaged by a mouth on the open end of the sleeve. The bit includes a lubrication system that excludes ambient drilling fluid, retainer means to rotatably secure the cutter to the sleeve and seal means which includes a cutter seal groove and a lug or shaft seal groove. A transverse shoulder is positioned inwardly of the seal means toward the inner region of the lug to avoid exposure of the mouth of the sleeve and the shoulder to ambient drilling fluid.

The seal means is a metal face seal assembly which includes a rigid ring and a resilient energizer ring, the transverse shoulder being positioned inwardly of the resilient energizer ring toward the inner end region of the lug to avoid exposure of the shoulder and the mouth of the sleeve to ambient drilling fluid.

In the preferred embodiment there are a pair of rigid rings and a pair of resilient energizer rings, with the intersection of the transverse shoulder and mouth sleeve being inwardly on the lug from the lug or shaft seal to exclude ambient drilling fluid.

Additional objects, features, and advantages of the invention will become apparent in the following description.

Figure 1:
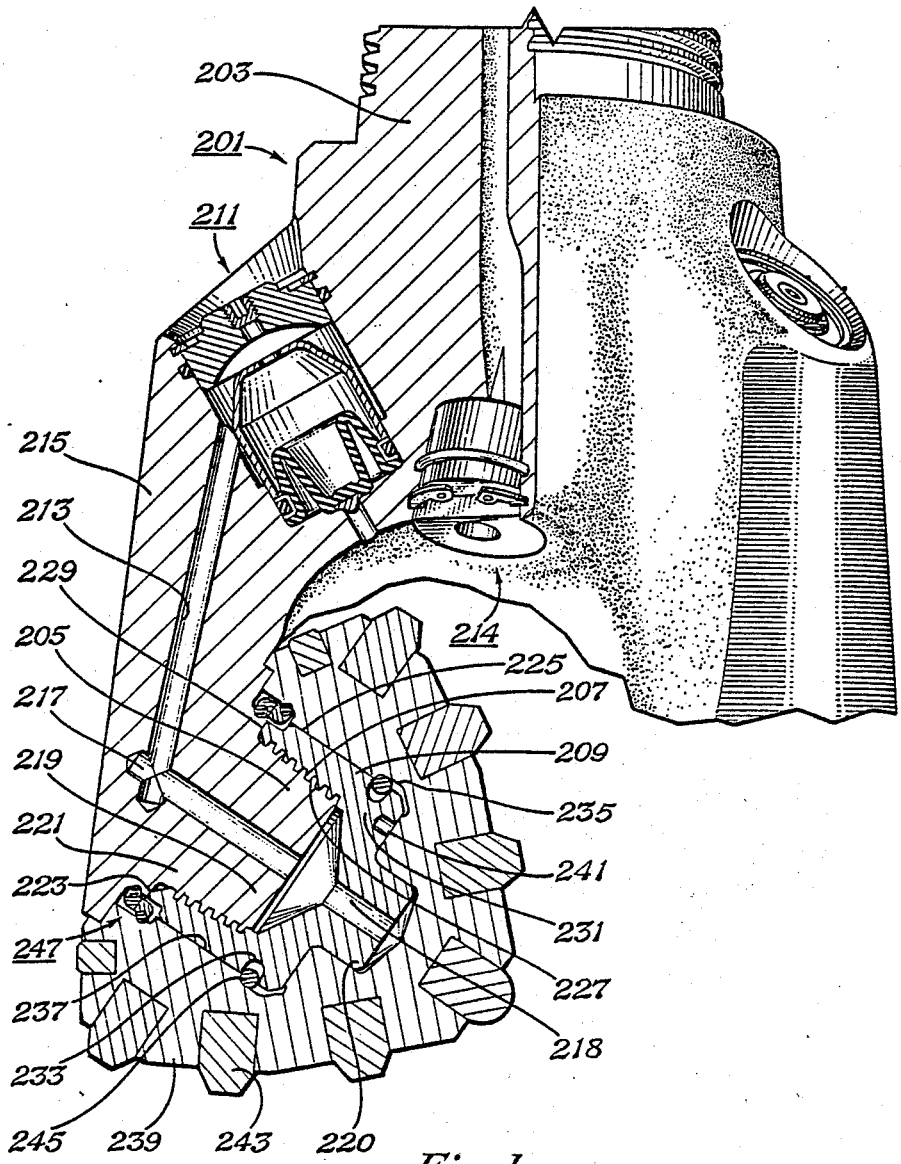
FIG. 1 is a fragmentary view of an embodiment of an earth boring bit, partially in longitudinal section, that utilizes a threaded bearing sleeve to form the journal bearing on a leg and a portion of a seal groove.

In the drawings an earth boring bit 201 has three head sections 203 that are welded to form a body. Extending inwardly and downwardly from each of the sections 203 is a cantilevered bearing lug 205, threaded at 207 to receive an internally threaded bearing sleeve 209. This type of bearing arrangement is shown in U.S. Pat. No. 4,600,064, "Earth Boring Bit With Bearing Sleeve", July 15, 1986.

In an upper portion of each head section 203 is a compensator 211 that forms part of a lubrication system that includes passages 213, a preferred form of compensator being shown in U.S. Pat. No. 4,276,946, "Biased Lubricant Compensator For An Earth Boring Drill Bit", July 7, 1981. Conventional nozzle means 214 direct drilling fluid toward a borehole bottom. A part of the passage 213 extends through the leg 215 of the section 203 into intersection with another passage 217, formed in this instance coaxially with the bearing lug 205. Lubricant is introduced from passage 217 through a passage 218 in a pilot pin 220 formed on sleeve 209.

The thread 207 formed on the exterior of the bearing lug 205 diverges outwardly from an inner end region 219 to an outer base region 221, having a shoulder 223 which is transverse or perpendicular with respect to the rotational axis of the lug 205.

The bearing sleeve 209 attached to the bearing lug 205 has a substantially cylindrical exterior journal bearing surface 225, a tapered and threaded interior portion 227 that mates with the threads 207 of the lug 205, and a traverse mouth 229 that mates and is intersecting with the shoulder 223 of the base region 221 of the lug.

From the drawing it is apparent that the bearing sleeve 209 and its cylindrical journal bearing portion 225 has a length greater than that of its threaded portion 227 to define a thick walled inner end portion 231 in which is formed an assembly groove 233 that opposes or registers with a retainer groove 235 formed in the cylindrical bearing portion 237 of the cutter 239. The minimum thickness of the metal between the assembly groove 233 and the threaded portion 227 of the bearing sleeve 209 for the 14¾ diameter bit provided by way of example should be substantially 0.422 inch. A drive pin hole 241 provides a means to apply a selected torque to the sleeve on assembly with the lug 205. The cutter is of a conventional configuration, with earth disintegrating teeth 243, and is retained on the bearing sleeve 209 with a resilient snap ring 245 having a curved cross section and groove configuration with curved bottom portion of the type disclosed in U.S. Pat. No. 4,236,764, "Earth Boring Drill Bit With Snap Ring Cutter Retention", Dec. 2, 1980.

The sleeve 209 has a boronizing treatment of the type describe in U.S. Pat. No. 3,922,038, "Wear Resistant Boronized Surfaces And Boronizing Methods", Nov. 25, 1975, on the exterior cylindrical surface 225 to improve wear resistance. This treatment provides the requisite improvement to wear resistance without causing a substantial weakening of the sleeve.

Figure 2:
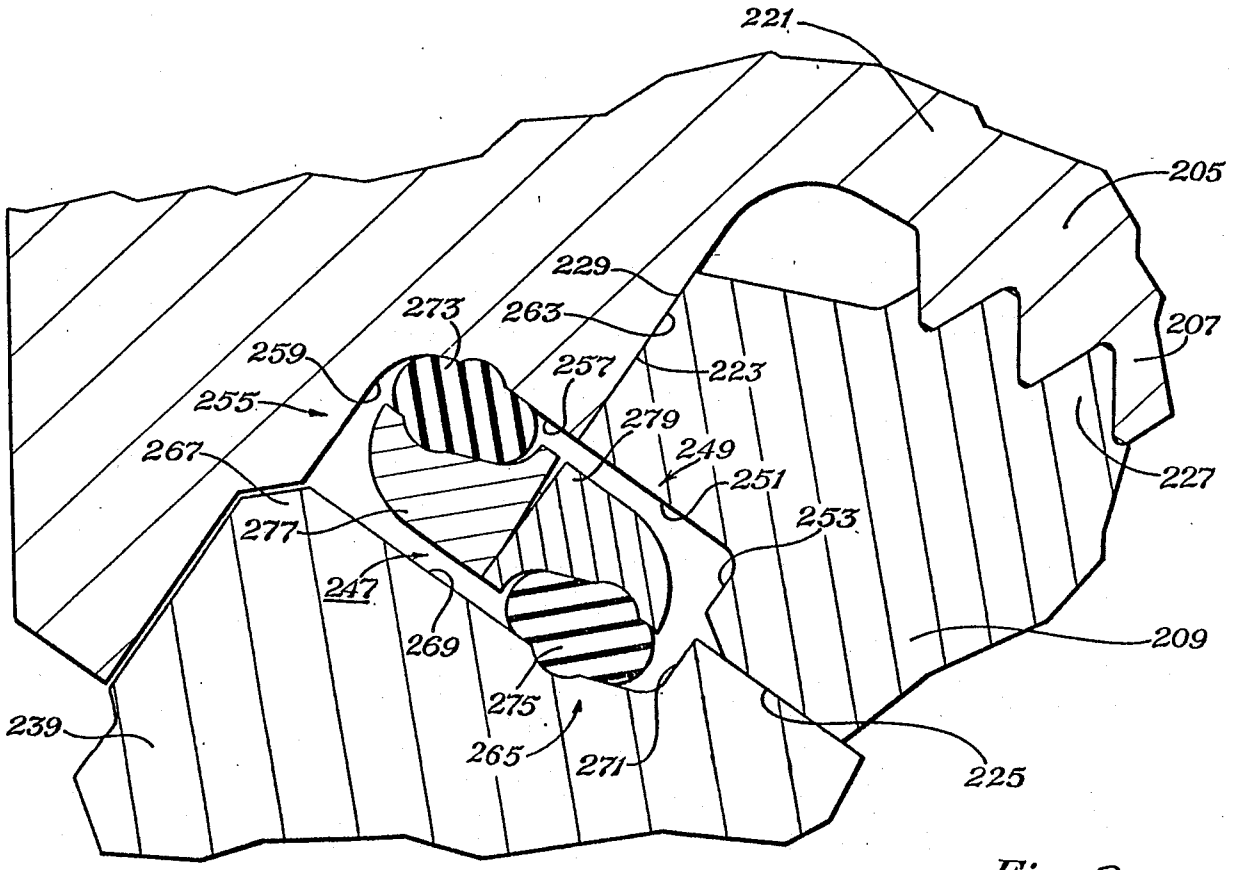
FIG. 2 is an enlarged fragmentary view in longitudinal section of the bearing, cutter and seal assembly of FIG. 1.

Referring to FIG. 2, the seal assembly 247 is disposed partially within a generally L shaped, shaft seal groove 249, a portion of which is in the outer end of the sleeve 209. The shaft or lug seal groove 249 includes a circumferential, generally cylindrical outer wall 251 and a radial inner end wall 253. A second portion 255 of the shaft seal groove 249 includes a circumferential wall 257 and a radial outer end wall 259 formed on the shoulder 233 on the base region of the bearing lug 205. The mouth 229 of the sleeve 209 is transverse and sealingly engages an opposed surface 263 of the shoulder 223 of the bearing lug 205.

An opposed, generally L-shaped cutter seal groove 265 is formed in the outer, mouth region 267 of the cutter 239, and includes a circumferential, generally cylindrical wall 269 and a radial end wall 271.

Confined within the above described cutter seal groove 265 and shaft seal groove 249 and a pair of energizer rings 273, 275 and a pair of rigid annular rings 277, 279. The journal bearing surface 225 of the bearing sleeve is located substantially midway between the circumferential walls 251, 269 in the preferred embodiment.

Lubricant pressure and volume changes in the vicinity of the seal assembly are minimized by positioning the seal groove and seal assembly in relation to the journal bearing surface such that the ratio of rigid ring seal movement to cutter movement is about one half.

The earth boring or rock bit described above is sometimes referred to as one having a "two piece bearing", which consists of the lug 205 and the bearing sleeve 209. The transverse shoulder 223 of the lug 205 is sealingly engaged by the mouth 229 of the bearing sleeve 209 and is positioned relative to the seal means or assembly 247 to avoid or prevent exposure of the mouth 229 and opposed surface 263 of the shoulder 223 to ambient drilling fluid in a bore hole. The seal 273 (FIG. 2) is positioned outward and away from contact with the intersection of the mouth 229 and shoulder 223.

This is accomplished by positioning the intersection of the transverse mouth 229 and opposed surface 263 of the shoulder 223 inwardly of the seal means or assembly toward the inner end region of the lug 205. In the embodiment of the invention disclosed in the drawings, the intersection is inwardly of the resilient energizer 273 of the rigid face seal assembly 247.

Ambient drilling fluid occupies a volume partially defined by surface 255 of the seal groove and only lubricant occupies the cutter seal groove partially defined by surface 265. So long as the energizer seals 273, 275 are effective, only lubricant resides in the vicinity of the intersection of the mouth 229 of the sleeve and the transverse shoulder 223.

It should be apparent to those skilled in the art that the invention has significant advantages. If there is a loss of complete sealing at the intersection of the mouth 229 of the sleeve and the opposed surface 263 of the shoulder 223, no ambient drilling fluid will reach the lubricant. Further, the intersection will not be exposed to any contaminants or corrosive material such as a hydrogen sulfide that sometimes appears in drilling fluids.

While the invention has been shown in only the preferred forms, it should be apparent to those skilled in the art that it is not thus limited, but is susceptible to various changes and modifications without departing from the spirit thereof.

I claim:

1. An earth boring bit having an improved two piece bearing and seal assembly which comprises:

a bit body which includes at least one leg and a cantilevered bearing lug that extends downwardly and inwardly;

a thread formed on the bearing lug to extend outwardly from an inner, end region to an outer, base region having a transverse shoulder;

a threaded bearing sleeve having a circumferential bearing surface secured to the bearing lug, and a mouth at one end intersecting the transverse shoulder;

a rotatable cutter with a bearing surface assembled on the bearing sleeve;

a lubrication system in the body, including a hydrostatic pressure compensator to lubricate said bearing surfaces and exclude ambient drilling fluids;

a cutter seal groove formed near the outermost region of the bearing surface in the cutter to have a circumferential wall and an end wall;

a circumferential shaft seal surface in the bearing lug to align with the bearing sleeve circumferential surface and oppose the cutter seal groove circumferential wall and to connect with an end wall in the lug;

retainer means for retaining the rotatable cutter on the bearing sleeve;

seal means for sealing against the circumferential walls of the cutter groove and lug seal surface;

the transverse shoulder of the bearing lug and mouth of the bearing sleeve being positioned inwardly of the region where the seal means engages the lug seal surface toward the inner end region of the lug and away from contact with the seal means to avoid exposure of the mouth of the sleeve to the ambient drilling fluid and to assure that lubricant resides on each side of the intersection of said shoulder and said mouth.

2. An earth boring bit having an improved two piece bearing and seal assembly which comprises:

a bit body which includes at least one leg and a cantilevered bearing lug that extends downwardly and inwardly;

a thread formed on the bearing lug to extend outwardly from an inner, end region to an outer, base region having a transverse shoulder;

a bearing sleeve with a bearing surface secured to the bearing lug, having a mouth at one end and a threaded portion, the mouth engaging the transverse shoulder;

a rotatable cutter with a bearing surface assembled on the bearing sleeve;

a lubrication system in the body, including a hydrostatic pressure compensator to lubricate said bearing surfaces and exclude ambient drilling fluids;

a cutter seal groove formed near the outermost region of the bearing surface in the cutter to have a circumferential, generally cylindrical wall;

a lug seal groove to oppose the cutter seal groove and having a circumferential, generally cylindrical wall;

retainer means for retaining the rotatable cutter on the bearing sleeve;

at least one rigid ring positioned between the shaft and cutter seal grooves with its sealing face engaging an opposed sealing face carried by the cutter;

at least one resilient energizer ring sealingly engaging the circumferential wall of the lug seal groove and sealingly engaging the rigid ring;

the transverse shoulder of the bearing lug and mouth of the bearing sleeve being positioned inwardly of and away from contact with the region where the resilient energizer ring engages the lug seal groove and toward the inner end region of the lug to avoid exposure of the mouth of the sleeve to ambient drilling fluid and to assure that only lubricant resides on each side of the plane where said shoulder engages said mouth.

3. An earth boring bit having an improved two piece bearing and seal assembly which comprises:

a bit body which includes at least one leg and a cantilevered bearing lug that extends downwardly and inwardly;

a thread formed on the bearing lug to extend outwardly from an inner, end region to an outer, base region having a transverse shoulder;

a bearing sleeve with a bearing surface secured to the bearing lug, having a mouth at one end and a threaded portion, the mouth engaging the transverse shoulder;

a rotatable cutter with a bearing surface assembled on the bearing sleeve;

a lubrication system in the body, including a hydrostatic pressure compensator to lubricate said bearing surfaces and exclude ambient drilling fluids;

a cutter seal groove formed near the outermost region of the bearing surface in the cutter to have a circumferential, generally cylindrical wall;

a lug seal groove formed at least partially in the bearing lug axially outward of the transverse shoulder to oppose the cutter seal groove and having a circumferential, generally cylindrical wall;

retainer means for retaining the rotatable cutter on the bearing sleeve;

a pair of rigid rings positioned in the seal groove to have opposed sealing faces;

a pair of resilient energizer rings, one of which sealingly engages a respective one of the rigid rings and the circumferential wall of the cutter and the other of which sealingly engages the other of the rigid rings and the circumferential wall of the lug seal groove;

the transverse shoulder of the bearing lug and mouth of the bearing sleeve being positioned inwardly toward the inner end region of the lug and inwardly of and away from contact with the region where the energizer ring engages the lug seal groove to avoid exposure of the mouth of the sleeve to ambient drilling fluid and assure that only lubricant resides on each side of the plane where said shoulder engages said mouth.

* * * * *